United States Patent [19]

Rigo

[11] 4,050,770

[45] Sept. 27, 1977

[54] JUNCTION BOX TERMINAL BLOCK

[76] Inventor: Larry E. Rigo, P.O. Box 805, Marietta, Ga. 30061

[21] Appl. No.: 732,843

[22] Filed: Oct. 18, 1976

[51] Int. Cl.[2] ..... H01R 9/10

[52] U.S. Cl. ..... 339/198 G; 174/59; 339/198 J; 339/272 R

[58] Field of Search ..... 339/198 R, 198 G, 198 GA, 339/198 J, 198 N, 198 E, 198 S, 198 P, 122 R, 132 R, 132 B, 272 R, 272 A; 174/53, 59, 60

[56] References Cited

U.S. PATENT DOCUMENTS

| | | | |
|---|---|---|---|
| 1,936,963 | 11/1933 | Dutzmann | 339/198 GA |
| 3,042,896 | 7/1962 | Doktor | 339/198 R |

FOREIGN PATENT DOCUMENTS

| | | | |
|---|---|---|---|
| A66,141 | 1/1956 | France | 339/198 GA |
| 1,284,660 | 1/1962 | France | 339/198 G |
| 713,389 | 8/1954 | United Kingdom | 174/59 |
| 1,423,531 | 2/1976 | United Kingdom | 339/272 A |

*Primary Examiner*—Roy Lake
*Assistant Examiner*—Neil Abrams
*Attorney, Agent, or Firm*—Dowell & Dowell

[57] ABSTRACT

A terminal block for mounting in a junction box and for terminating electrical power feed conductors and joining them to other power distribution wires, the block which has particular utility in multiple phase power systems has a different lug for each phase, each lug having multiple cable receiving bores with set screws for securing the cables in the bores, the set screws all being accessible from the exposed outer surfaces of the block, and the lugs being supported side by side in an insulating housing mutually separated by partitions, the housing having a cover for covering all the lugs.

6 Claims, 4 Drawing Figures

40
S
41
S
41
17
19
17
36
10
20
20
17
19
30
21
18
22
23
24
21
18
34
22
33
16
20
30
29
24
23
32
28
20
30
31
27
33
32
14
13
18
11
13
DEPTH
14
LENGTHWISE
WIDTHWISE
12
11

JUNCTION BOX TERMINAL BLOCK

FIELD OF INVENTION

This disclosure relates to terminal blocks for mounting in a junction box, and particularly relates to terminal blocks of the type used for fanning out the feed conductors on the secondary side of a main disconnect or circuit breaker whose primary side is connected to the main entry power cables.

BACKGROUND AND PRIOR ART

The usual way prior to this invention of connecting electrical power cables entering a building and fanning them out to the various secondary service disconnects in the building is by the use of clamping means, such as multiple split-bolt connectors into each of which one phase conductor of the power cable is inserted and is clamped in contact with one or more wires leading to a sub-disconnect box or to one or more service circuits. At each such conection, the split-bolt connector is screwed up tightly on the various conductors clamped therein. Then the split-bolt connector is padded to cover sharp edges thereof, and then the padded joint is heavily taped to provide the necessary insulation. These joints are made in an electrical junction box in the shape of a trough, the trough having attached ends and a cover which is screwed to flanges extending around the edges of the trough and end plates. It is not only a laborious job to make a joint using a split-bolt connector and tape, but the joint, when completed, suffers from serious defects. One defect is that the joint is not accessible under the tape so that the circuit wiring cannot be easily altered, for instance, to add new circuitry thereto. A much more serious maintenance problem, also attributable to the inaccessibility of the taped joint, is that the split-bolt joint can not be periodically tightened on the wires without turning off the power and removing the tape to reach and tighten the bolt clamp.

Periodic tightening of the joints is necessary to prevent loosening of the joint due to heat expansion and contraction. As heavy electrical loads are drawn, he circuit conductors heat and expand. When the load is reduced, they cool and contract, leaving a looser joint. Over a period of time, a joint can be loosened to such an extent that it develops a resistive spot where a great deal of heat builds up, sometimes causing a fire. The present invention provides an accessible terminal block for terminating power lines while facilitating the periodic maintenance steps of tightening of the wire securing screws, this terminal block also facilitating the adding of additional circuits thereto.

The prior art shows a great variety of screw type terminals mountable in junction boxes, for example, U.S. Pat. No. 2,863,935 to Barina issued Dec. 9, 1958, and German Pat. No. 1,199,355 to Knappe issued Aug. 25, 1965.

THE INVENTION

The invention provides a heavy duty terminal block having separate metal lugs corresponding with each phase of the electrical service, and each lug having multiple wire-receiving bores extending into it, with a set screw threaded into and intersecting each bore. The lugs are all supported side by side in an insulating housing, and each lug is held in a recess shaped to fit the lug and keep it precisely positioned with respect to the other lugs. The housing has a hole through it aligned with each wire receiving bore to admit a conductor, or conductors, into that bore from outside the block. The block is provided with a mounting bracket molded into the housing and disposed to overlie the flanges of the junction box trough and be secured thereto. When thus mounted in a trough, all of the bores of all of the lugs extend through the transverse walls parallel to the lengthwise dimensions of the trough so that all wires enter from an accessible direction and are not blocked by the sides of the trough. All of the set screws of all the lugs face outwardly of the block, and are readily accessible for tightening from the exposed outer face of the terminal block. The terminal block housing has partitions of insulating material extending parallel to the lengthwise dimension of the trough and separating the individual phase conductor lugs. An insulating cover fits over the housing and covers all of the lugs and set screws, the cover having ribs on its inner surface mating with the partitions when the cover is in place over the block.

It is a principal object of the invention to provide a heavy duty terminal block for terminating multiple phase electrical mains in a safe manner using screw type junctions which are easily tightened, permitting preventive maintenance and easy circuit alteration.

Yet another object of the invention is to provide a block for terminating the secondary power lines leaving a main circuit breaker or a main disconnect in screw type lugs which maintain the connections of the wires neatly organized and substantially exposed after removing a cover, as opposed to taped, so that joints can be periodically inspected and, if need be, tightened with the power "on".

A further object of the invention is to provide a bracket supported terminal block which can mount in a standard service entry box trough and which can be designed for 200 Amps., 400 Amp., 600 Amp., 800 Amp., 1000 Amp., or 1200 Amp. service, in each such service the terminal block being so oriented by the mounting bracket that the wires which enter the bores through the transverse walls of the block always make their entry in a direction parallel to the lengthwise dimension of the trough. As many such blocks are mounted along the trough side-by-side as may be required for the circuitry or as may be permitted by the National Electrical Code.

Still a further object of the invention is to provide an improved terminal block which can be readily molded of insulating material with the various lugs in place in the housing, and which has a complementary molded cover which fits over and encloses the housing, protecting the conductive parts from accidental contact therewith. These terminal blocks are especially useful in terminating secondary power lines sized from about No. 8 wire to about 1000 MCM cable.

Another important object of the invention is to provide a terminal block construction in which the various lugs terminating the several phase conductors are stepped inwardly and then outwardly depthwise of the terminal block so as to provide different levels at which the separate conductors enter the various wire terminating bores, these bores being staggered out of alignment depthwise of the block so that the wires are not all aligned with each other, and are therefore more readily distinguishable and accessible.

A further object is to provide a terminal block having stepped lugs which are especially shaped to reduce the amount of metal in each lug, whereby it can be more economically manufactured.

Other objects and advantages of the invention will become apparent during the following discussion of the drawings:

THE DRAWINGS

Figure 1:
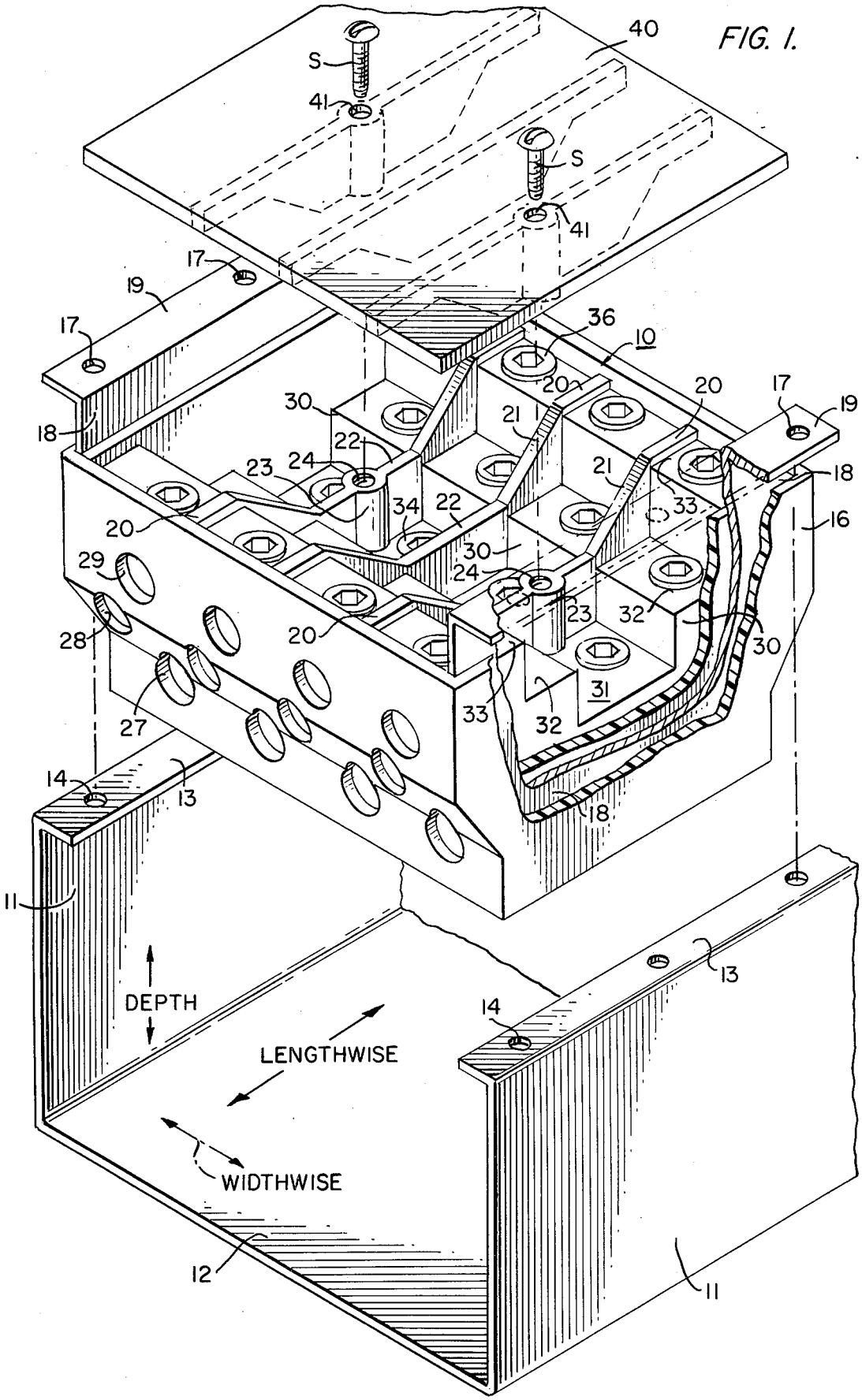
FIG. 1 is an exploded perspective view, partly in section, of a terminal block and cover according to the invention oriented for mounting in a junction box trough.
Figure 4:
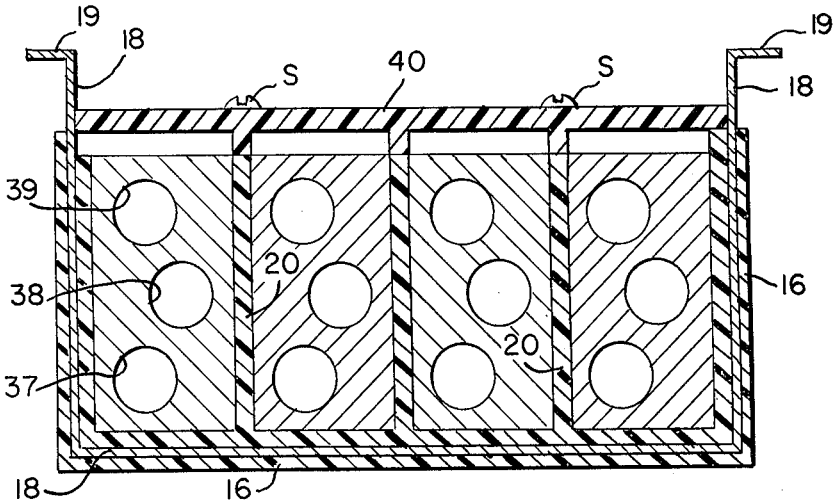
FIG. 4 is a sectional view taken along line 4—4 of FIG. 2.

Referring now to the drawings, FIG. 1 shows an exploded perspective view of a terminal block 10 suitable for mounting in a terminal box trough 12, the box having flanges 13 with mounting holes 14 through the flanges. The terminal block comprises a molded housing 16 made of suitable plastic material such as Bakelite, and the housing having a mounting bracket 18 integrally molded thereinto, the bracket being metal and having flanges 19 which overlie the flanges 13 of the junction box trough, and the bracket 18 having holes 17 which align with the holes 14 in the junction box trough so that the mounting bracket 18 can be secured thereto, for instance, by sheet metal screws. The manner in which the mounting bracket 18 is molded into the housing 16 can be clearly seen in FIGS. 2 and 4.

Figure 2:
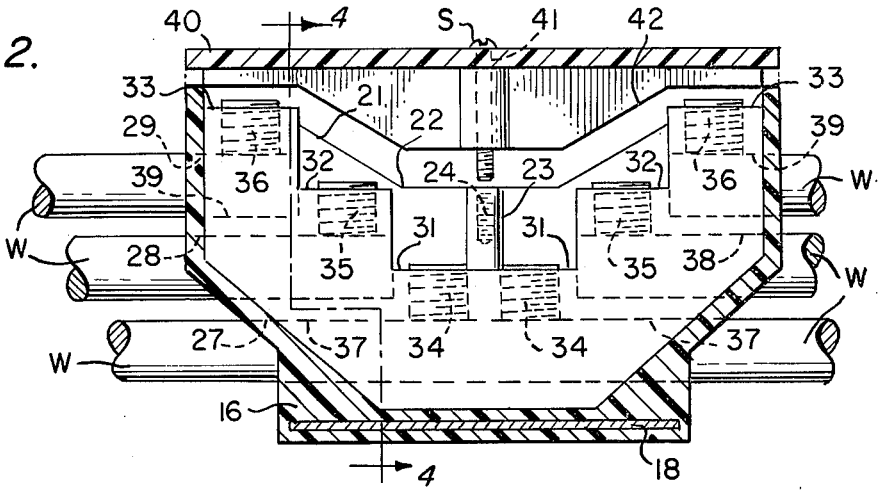
FIG. 2 is a cross-sectional view taken along line 2—2 of FIG. 3, FIG. 2 being taken parallel to the lengthwise dimension of the lugs.
Figure 3:
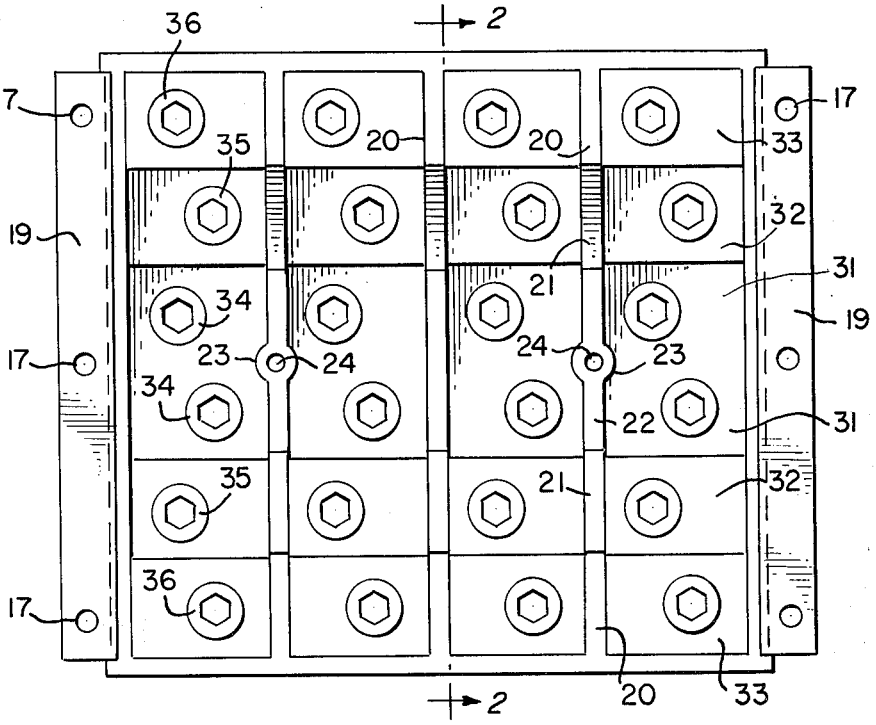
FIG. 3 is a plan view of the terminal block.

The insulating housing 16 is provided with a series of longitudinal partitions 20 which are molded as part of the housing 16. These partitions provide between them a series of four recesses in the housing 16, and each of these recesses receives a metal lug 30, there being, for instance, one lug for each phase conductor of entering electrical service cables. The lugs 30 precisely fit into the recesses between the partitions 20, and the lugs 30 are shaped so that their outwardly facing surfaces are stepped as can be seen best in FIGS. 1 and 2, thereby providing lugs having deeply stepped innermost portions 31, intermediate portions 32 and outermost portions 33. The lugs drilled and tapped to provide screw holes extending in the depth direction through the exposed outer surfaces of the stepped portions 31, 32, and 33 of the lugs, and these tapped holes receive set screws 34, 35, and 36, respectively. These screws intersect a series of wire-receiving bores 37, 38 and 39, FIG. 2 showing wires W extending into these bores. Thus, each lug has 6 wire receiving bores and 6 set screws intersecting these bores and useful for tightening and clamping wires W entered into the bores.

Referring now to FIG. 1, the housing 16 also has holes in its transverse sides, these holes being labelled 27, 28, and 29, and corresponding with the bores 37, 38, and 39 in the lugs 30.

Each of the partitions 20 steps inwardly along a diagonal portion 21 and ends in an inner portion 22. Two of the partitions at their inner portions 22 have enlarged bosses 23 which have screw holes 24 extending inwardly thereinto to receive the screws S which hold the cover 40 in place as will be described hereinafter with reference to FIG. 1.

The cover 40 as shown in FIGS. 1 and 2 has two holes 41 extending through it and passing downwardly through ribs 42 which compliment the shape of the outer edges 20, 21 and 22 of the partitions in the housing, when the lid is in place. The screws S pass through two of these ribs at enlarged bosses 43 which compliment the shape of the bosses 23 of two of the partitions.

The ribs 42 serve to strengthen the cover 40 and add stiffness to it, and serve also to prevent cracking or breaking of the cover in the event that a workman tightens the screws S too much.

In order to clarify the directions referred to in the specification and claims, the junction box trough 12 as shown in FIG. 1 is provided with legends showing the directions referred to as lengthwise or longitudinal, widthwise or transverse, and depthwise. It should be noted that the same terms apply also to the junction block 10 as shown in FIG. 1 which has its wire receiving bores oriented lengthwise with respect to the junction box through 12 so that the sides 11 of the trough do not interfere with the insertion and removal of the wires into the wire receiving bore of the terminal block through the transverse walls, thereby facilitating the wiring of circuitry.

It is to be understood that the trough may be made as long as desired and that a number of a terminal blocks similar to the block 10 can be mounted at spaced intervals along the length of the trough 12. The use of multiple terminal blocks can be of considerable assistance in fanning out a power entry cable into a number of subcircuits, perhaps using jumpers from one phase lug in one terminal block to a corresponding lug in one or more other blocks to increase the fan-out capability.

The present invention is not to be limited to the exact embodiment shown in the drawings, for obviously, changes may be made within the scope of the following claims.

I claim:

1. A terminal block for mounting across the width of a junction box trough for terminating wires extending into the trough, each terminal block comprising:

an insulated housing of width selected to fit within the width of the trough, the housing having lengthwise-extending partitions dividing it into side-by-side lug receiving recesses extending the full length of the housing and extending into the depth of the block toward its bottom from its exposed upper surface;

a conductive terminal lug in each recess, each lug extending the full length of a recess and being inwardly stepped along the length of the lug from a first level near the upper surface of the housing at each end to a recessed level at the central portion of the lug to provide multiple different levels of exposed surfaces located adjacent to each other;

the housing and each of the lugs having wire receiving bores opening through both sides of the housing toward said central portions and extending beneath different surface levels parallel to the length dimensions of the lugs, each uppermost bore ending beneath one of said first levels and each lowermost bore ending beneath said central portion;

a set screw extending into a tapped hole from each of said surface levels and intersecting a bore for clamping a wire in the bore, and all the set screws being accessible from the exposed surfaces of the lugs; and the transverse ends of each recess and the transverse ends of each lug being shaped to converge toward said central portion from a level beneath said uppermost bore to the bottom of the lug and the recess of the housing, thereby to shorten the length of the lower portion of the lug and of the lowermost bores beneath said central portion.

2. A terminal block as set forth in claim 1, for terminating a multiple phase service inlet including conductors for the several phases, said block including a separate lug for each phase and the wires associated with one phase conductor entering bores of the same lug and being clamped therein by set screws, and other wires associated with the same phase fanning out from different bores of the same lug.

3. A terminal block as set forth in claim 1, wherein each terminal lug is stepped inwardly to its greatest depth at its longitudinal central portion and is stepped outwardly to lesser depths symmetrically on opposite sides of its longitudinal center.

4. A terminal block as set forth in claim 1, wherein the bores entering the successive levels of the lugs and extending through each end of the housing are staggered out of mutual alignment looking down upon the block toward its depth.

5. A terminal block for mounting across the width of a junction box trough for terminating wires extending into the trough, each terminal block comprising:

an insulated housing of width selected to fit within the width of the trough, the housing having lengthwise-extending partitions dividing it into side-by-side lug receiving recesses extending into the depth of the block toward its bottom from its exposed under surface;

a conductive terminal lug in each recess, each lug being inwardly stepped along the length of the lugs to provide different levels of exposed surfaces located adjacent to each other;

the housing and the lugs having wire receiving bores opening through the sides of the housing and extending parallel to the length dimensions of the lugs and each bore ending beneath one of said different surface levels;

a set screw extending into a tapped hole from each of said surface levels and intersecting a bore for clamping a wire in the bore, and all the set screws being accessible from the exposed surfaces of the lugs; and a mounting bracket embedded in the insulating housing and passing beneath the lugs, and up the longitudinal sides of the housing, and the bracket including mounting flanges extending away from the housing and disposed for attachment to the sides of the terminal box trough.

6. A terminal block for mounting across the width of a junction box trough for terminating wires extending into the trough, each terminal block comprising:

an insulated housing of width selected to fit within the width of the trough, the housing having lengthwise-extending partitions dividing it into side-by-side lug receiving recesses extending into the depth of the block toward its bottom from its exposed upper surface;

conductive terminal lug in each recess, each lug being inwardly stepped along the length of the lugs to provide different levels of exposed surfaces located adjacent to each other;

the housing and the lugs having wire receiving bores opening through the sides of the housing and extending parallel to the length dimensions of the lugs and each bore ending beneath one of said different surface levels;

a set screw extending into a tapped hole from each of said surface levels and intersecting a bore for clamping a wire in the bore, and all the set screws being accessible from the exposed surfaces of the lugs; and the central portions of said partitions between the lugs being depressed below the exposed upper surface of the block; an insulating cover shaped to overlie the housing and cover the lugs and set screws, the cover having ribs of insulating material shaped to mate with the depressed central portions of the partitions when the cover is in place, the ribs strengthening the cover; and means to attach the cover to the housing.

* * * * *